US005771611A

United States Patent [19]

Chang

[11] Patent Number: 5,771,611

[45] Date of Patent: Jun. 30, 1998

[54] TRANSPARENT, LIGHTED SOLE CONSTRUCTION

[75] Inventor: Chung-Tang Chang, Taichung City, Taiwan

[73] Assignee: Shuang-Bang Industrial Corporation, China

[21] Appl. No.: 666,233

[22] Filed: Jun. 20, 1996

[51] Int. Cl.[6] ..... A43B 23/00

[52] U.S. Cl. ..... 36/137; 36/29

[58] Field of Search ..... 36/137, 100, 101, 36/11.5, 29

[56] References Cited

U.S. PATENT DOCUMENTS

| | | | |
|---|---|---|---|
| 2,381,389 | 8/1945 | Riesing | 36/11.5 X |
| 2,755,567 | 7/1956 | Rudine | 36/11.5 |
| 2,889,639 | 6/1959 | Rudine | 36/11.5 X |
| 4,012,855 | 3/1977 | Gardner | 36/29 |
| 4,020,572 | 5/1977 | Chiaramonte, Jr. | 36/137 |
| 4,041,618 | 8/1977 | Famolare, Jr. | 36/29 X |
| 4,130,951 | 12/1978 | Powell | 36/137 |
| 4,546,556 | 10/1985 | Stubbefield | 36/29 X |
| 5,197,206 | 3/1993 | Shorton | 36/29 |
| 5,220,737 | 6/1993 | Edington | 36/29 X |
| 5,692,324 | 12/1997 | Goldston et al. | 36/137 |

FOREIGN PATENT DOCUMENTS

| | | | |
|---|---|---|---|
| 94015494 | 7/1994 | WIPO | 36/137 |

*Primary Examiner*—B. Dayoan

*Attorney, Agent, or Firm*—Ostrolenk, Faber, Gerb & Soffen, LLP

[57] ABSTRACT

A sole construction includes a midsole and a sole layer. The midsole is made of a transparent polyurethane material and has a toe portion, a heel portion, a plurality of side-by-side adjacent air cavities, and a plurality of walls which confine the air cavities. The walls include a base wall, a plurality of resilient upright partition walls formed on the base wall, and a transparent peripheral wall which extends upwardly from the base wall so as to surround the air cavities and the partition walls. Each of the cavities is open at one side opposing the base wall. The sole layer is adhesively bonded so as to cover the side of the midsole opposite to the base wall. A plurality of light emitting units can be disposed in the air cavities located along the peripheral wall in order to emit light from the periphery of the midsole.

5 Claims, 5 Drawing Sheets

TRANSPARENT, LIGHTED SOLE CONSTRUCTION

BACKGROUND OF THE INVENTION

1. Field of the Invention

The invention relates to a sole construction, more particularly to a midsole which is sandwiched between an upper sole and a lower sole for cushioning purposes.

2. Description of the Related Art

A sole construction includes an upper sole, a lower sole and a midsole sandwiched between the upper and lower soles for cushioning purposes. Presently, there are some shoes which are capable of emitting light intermittently. The reason resides in that a light emitting unit is generally disposed within an air cavity formed at the rear portion of a conventional midsole. In addition to the light emitting unit, an air enclosure is also disposed in the air cavity for cushioning purposes. It is noted that relatively complicated steps are involved during insertion of the air enclosure and the light emitting unit into the cavity of the midsole, thereby resulting in a relatively high manufacture cost and in a relatively long assembly time.

SUMMARY OF THE INVENTION

The object of this invention is to provide a sole construction including a midsole which has a plurality of air cavities that can be formed easily so as to provide cushion effects and so as to accommodate a plurality of light emitting units therein.

Accordingly, a sole construction of this invention includes a midsole and a sole layer. The midsole is made of a transparent polyurethane material and has a toe portion, a heel portion, a plurality of walls which confine the air cavities. The walls include a base wall, a plurality of resilient upright partition walls formed on the base wall, and a transparent peripheral wall which extends upwardly from the base wall so as to surround the air cavities and the partition walls. Each of the air cavities is open at one side opposing the base wall. The sole layer is adhesively bonded so as to cover the side of the midsole opposite to the base wall. A plurality of light emitting units can be disposed in the air cavities located along the peripheral wall in order to emit light from the periphery of the midsole.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENTS

Figure 1:
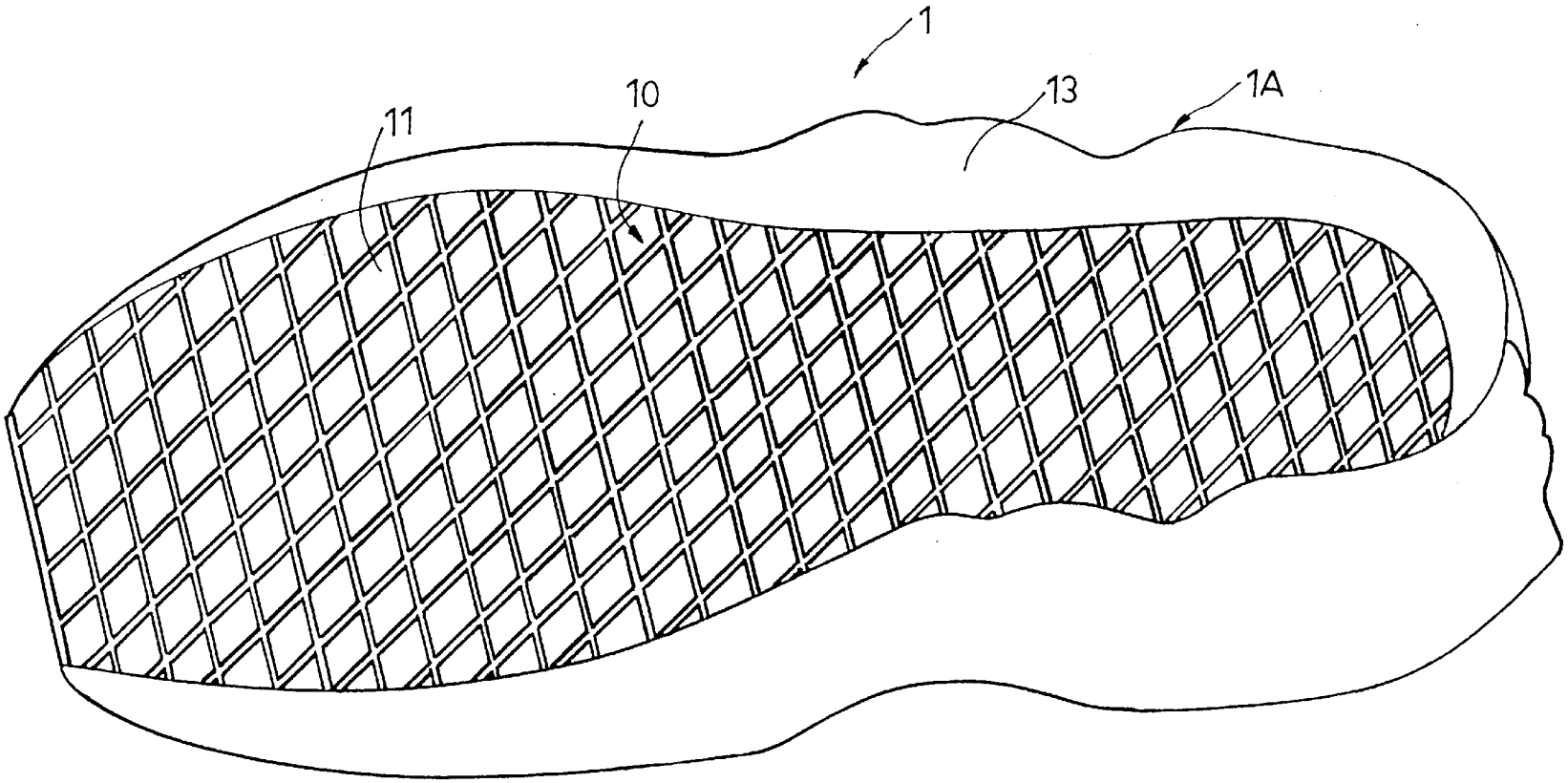
FIG. 1 is a perspective view of a sole construction of this invention.

Referring to FIGS. 1, 2, 3 and 4, the preferred embodiment of a sole construction 1 according to this invention includes a midsole 1A and a sole layer 30.

As illustrated, the midsole 1A is made of a transparent polyurethane material and has a toe portion 111, a heel portion 112, a plurality of side-by-side adjacent air cavities 11, and a plurality of walls 10 which confine the air cavities 11. The walls 10 include a base wall 20, a plurality of resilient upright partition walls 101 formed on the base wall 20, and a transparent peripheral wall 13 which extends upwardly from the base wall 20 so as to surround the air cavities 11 and the partition walls 101. Each of the air cavities 11 is open at one side opposing the base wall 20.

The sole layer 30 is bonded adhesively so as to cover the side of the midsole 1A opposite to the base wall 20 such that the whole assembly can provide cushion effects to the user. In this embodiment, the air cavities 11 are isolated from one another, are generally rhomboidal in shape and are located independently from one another. The air cavities 11 can be arranged either uniformly or non-uniformly on the base wall 20. The air cavities 11 may be gastight type or gas permeable type. In use, the sole construction of this invention provides flexibility, comfort and vibration absorption.

Figure 2:
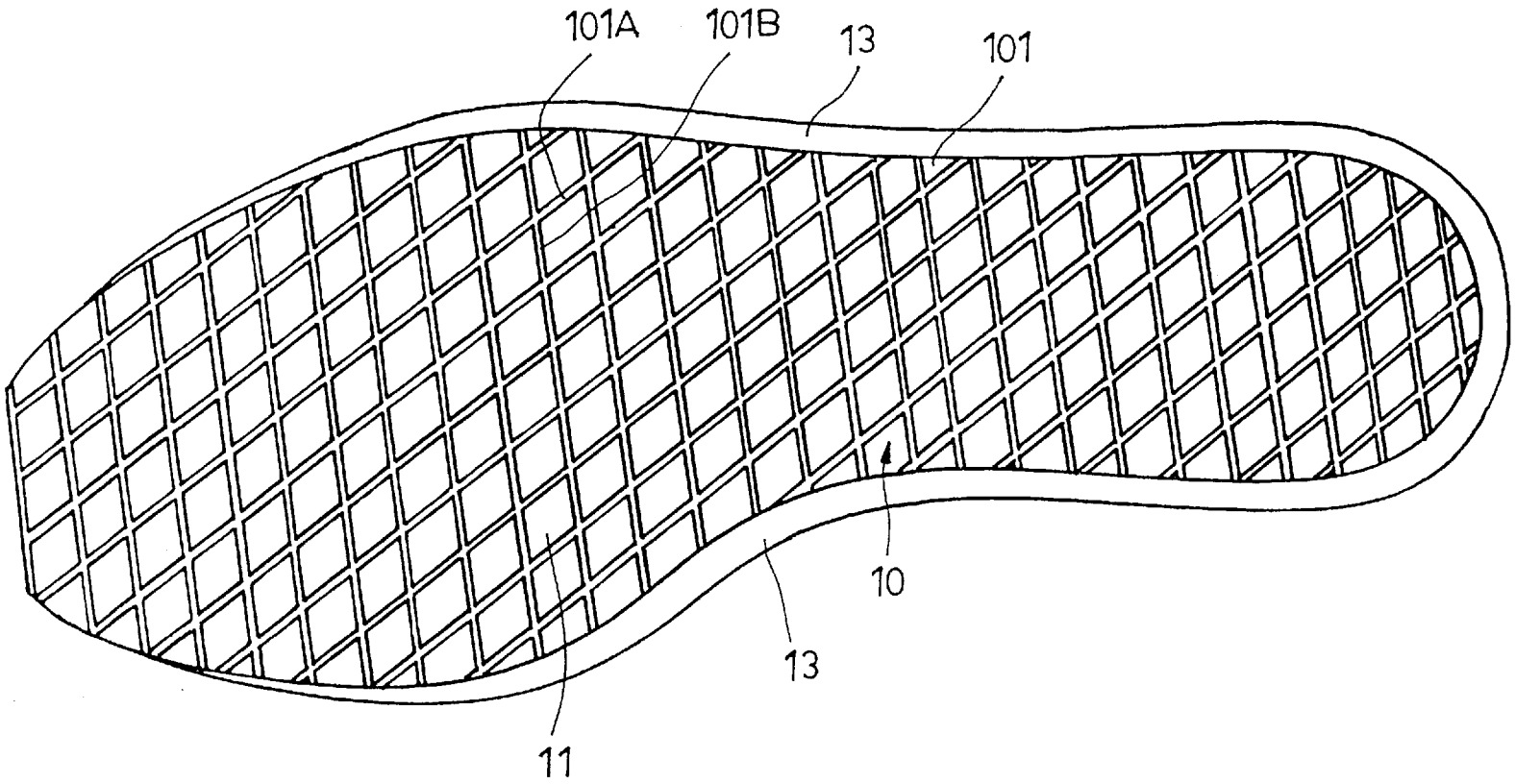
FIG. 2 illustrates a top view of a midsole employed in the sole construction of this invention.
Figure 3:
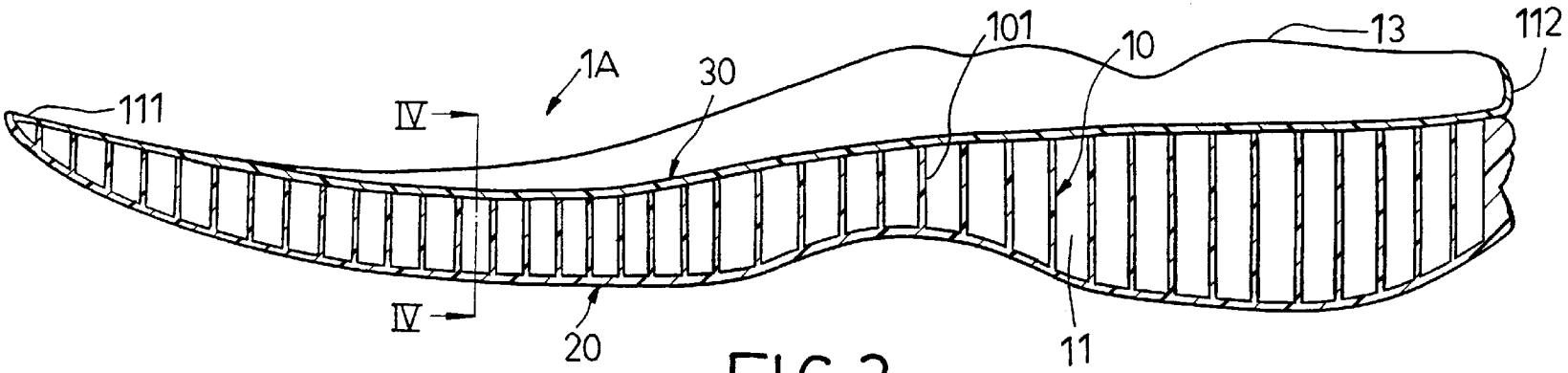
FIG. 3 is a sectional view of the sole construction of this invention.
Figure 4:
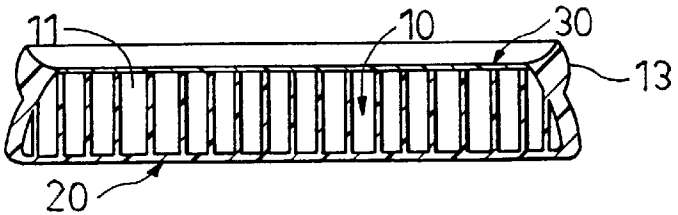
FIG. 4 is a sectional view of the sole construction of this invention, taken along line IV—IV in FIG. 3.

As best illustrated in FIG. 2, the partition walls 101 are transparent and include a plurality of first parallel walls 101A transverse to a line which extends from the toe portion to the heel portion of the midsole, and a plurality of second parallel walls 101B which intersect the first parallel walls 101A at acute or obtuse angles. It is noted that the first and second parallel walls 101A, 101B have a thickness ranging from 1 mm to 1.5 mm.

Note that the peripheral wall, the base wall and the partition walls can be integrally formed by an extrusion machine. The attachment of the sole layer on the midsole can be accomplished by any conventional art. Therefore, no complicated steps are involved during the manufacture of the sole construction and the cost of production is consequently decreased.

Figure 5:
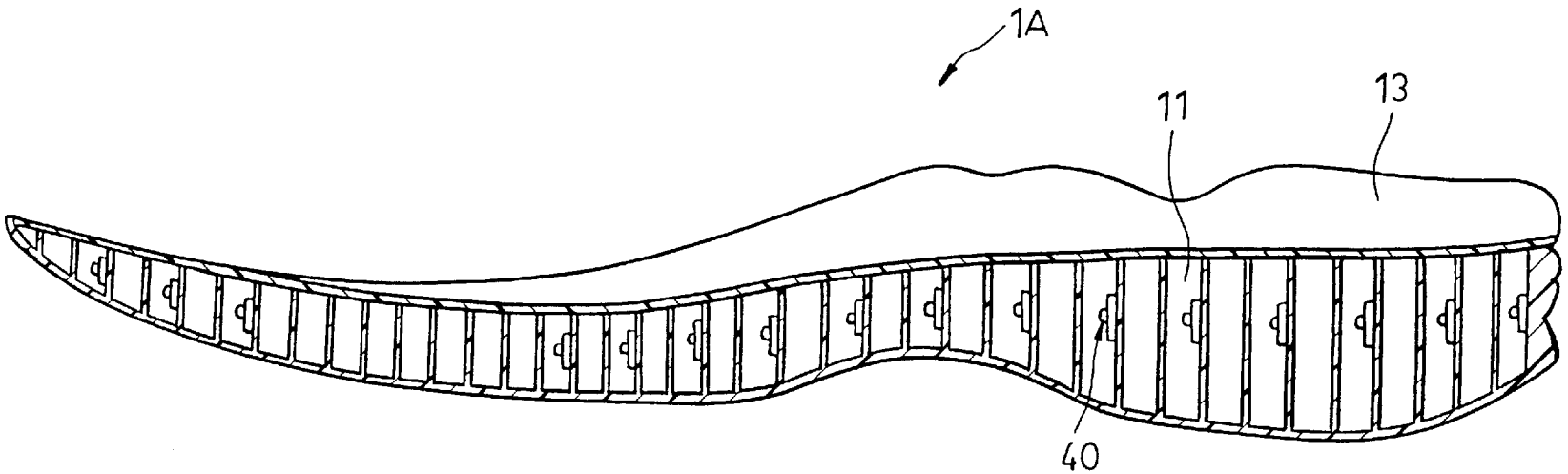
FIG. 5 is a sectional view of a modified sole construction of this invention.

As shown in FIG. 5, a plurality of light emitting units 40, such as light emitting diodes, are disposed in the air cavities 11 adjacent to the transparent peripheral wall 13 such that light is visible from an exterior of the midsole via the peripheral wall 13.

Figure 6:
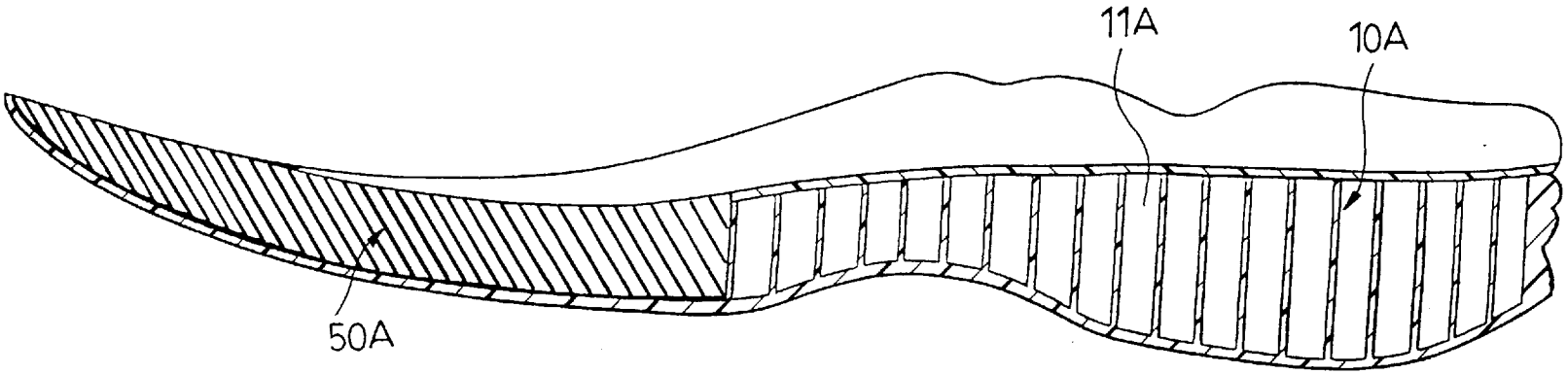
FIG. 6 is a sectional view of another modified sole construction of this invention.

Referring to FIG. 6, in a modified embodiment of this invention, the front part of the sole construction is stuffed with foam material 50A while the rear part has a plurality of air cavities 11A confined by a plurality of walls 10A similar to that of the previous embodiment. The foam material 50A and the air cavities 11A provide cushion effects to the user.

With this invention thus explained, it is obvious to those skilled in the art that various modifications and variations can be made without departing from the scope and spirit thereof. It is therefore intended that the invention be limited only as in the appended claims.

I claim:

1. A sole construction comprising:

a one-piece unitary midsole made of a transparent polyurethane material and having a toe portion, a heel portion, a plurality of side-by-side adjacent cavities, and a plurality of transparent walls which confine said cavities, said transparent walls including a base wall, a plurality of resilient upright partition walls formed on said base wall, and a transparent peripheral wall extending upward from said base wall so as to surround said cavities and said partition walls, said cavities having open ends opposite to said base wall;

a sole layer bonded to said midsole at said open ends of said cavities; and light emitting units provided in some of said cavities to emit light to said transparent walls of said cavities, including said peripheral wall.

2. The sole construction according to claim 1, wherein said partition walls include first parallel walls transverse to a line extending from said toe portion to said heel portion of said midsole, and second parallel walls intersecting said first parallel walls at an obtuse angle.

3. The sole construction of claim 1, wherein said light emitting units are disposed in the cavities adjacent the peripheral wall for enabling light to be visible from the exterior of the midsole through the peripheral wall.

4. The sole construction of claim 3, wherein each light emitting unit comprises a light emitting diode in one of the cavities.

5. The sole construction of claim 1, wherein each light emitting unit comprises a light emitting diode in one of the cavities.

* * * * *